US011610553B2

(12) United States Patent
Piao et al.

(10) Patent No.: US 11,610,553 B2
(45) Date of Patent: Mar. 21, 2023

(54) PIXEL SENSING DEVICE AND PANEL DRIVING DEVICE FOR ADJUSTING DIFFERENCES AMONG INTEGRATED CIRCUITS

(71) Applicant: SILICON WORKS CO., LTD., Daejeon (KR)

(72) Inventors: Taiming Piao, Daejeon (KR); Young Bok Kim, Daejeon (KR); Won Kim, Daejeon (KR); Young Ho Shin, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 187 days.

(21) Appl. No.: 17/124,934

(22) Filed: Dec. 17, 2020

(65) Prior Publication Data

US 2021/0193056 A1 Jun. 24, 2021

(30) Foreign Application Priority Data

Dec. 19, 2019 (KR) ..... 10-2019-0171073

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/0291* (2013.01); *G09G 2310/0294* (2013.01); *G09G 2310/0297* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 10,229,621 | B2 | 3/2019 | Chin | |
| 2016/0063925 | A1 | 3/2016 | Bae et al. | |
| 2016/0063950 | A1 | 3/2016 | Shin | |
| 2016/0314739 | A1 * | 10/2016 | Huang | G09G 3/3233 |
| 2020/0013333 | A1 * | 1/2020 | Hwang | G09G 3/3275 |

FOREIGN PATENT DOCUMENTS

| | | | | |
|---|---|---|---|---|
| KR | 10-2016-0028597 A | | 3/2016 | |
| KR | 20180103271 | * | 9/2018 | G09G 3/006 |
| KR | 10-2019-0024364 A | | 3/2019 | |

* cited by examiner

*Primary Examiner* — Ifedayo B Iluyomade
(74) *Attorney, Agent, or Firm* — Rothwell, Figg, Ernst & Manbeck, P.C.

(57) ABSTRACT

The present disclosure relates to a technology for adjusting differences among integrated circuits, that may occur in a pixel sensing, using bias voltages, and more particularly, a technology for adjusting a gain or an offset of each integrated circuit by adjusting a bias voltage.

16 Claims, 12 Drawing Sheets

PHASE 1

PHASE 2

PIXEL SENSING DEVICE AND PANEL DRIVING DEVICE FOR ADJUSTING DIFFERENCES AMONG INTEGRATED CIRCUITS

CROSS REFERENCE TO RELATED APPLICATION

This application claims priority from Republic of Korea Patent Application No. 10-2019-0171073, filed on Dec. 19, 2019, which is hereby incorporated by reference in its entirety.

BACKGROUND

1. Field of Technology

The present disclosure relates to a pixel sensing technology. More particularly, it relates to a technology for removing differences among integrated circuits (IC) that could occur when sensing pixels.

2. Description of the Prior Art

A display device comprises a source driver for driving pixels disposed on a panel.

A source driver determines data voltages in accordance with image data and supplies these data voltages to pixels to control the brightness of each pixel.

Here, even if the same data voltage is supplied, the brightness of each pixel varies depending on characteristics of each pixel. For example, a pixel comprises a driving transistor and when a threshold voltage of the driving transistor is changed, the brightness of the pixel is changed even if the same data voltage is supplied to the pixel. If a source driver does not reflect such characteristic changes of pixels, pixels would be driven at an undesired brightness, and this may cause a degradation of image quality.

To be clear, characteristics of a pixel vary depending on time or the pixel's surrounding environment. Nevertheless, if a source driver supplies data voltages without reflecting such varied characteristics of pixels, this may cause a degradation of image quality, for example, burn-in.

In order to solve the problem of degradation of image quality, a display device may comprise a pixel sensing device to sense characteristics of pixels.

A pixel sensing device may receive sensing signals for pixels through sensing lines respectively connected with the pixels. The pixel sensing device converts the sensing signals into sensing data and transmits the sensing data to a timing controller which identifies characteristics of pixels by the sensing data. The timing controller may compensate image data by reflecting characteristics of pixels to alleviate the problem of degradation of image quality due to differences among pixels.

A pixel sensing device may comprise a plurality of integrated circuits and simultaneously sense a plurality of pixels using these integrated circuits. However, such integrated circuits may respectively have differences among them depending on their manufacturing processes, driving environments, or the like. For example, each integrated circuit may comprise an amplifier circuit and an analog-digital converting circuit: the amplifiers in the respective integrated circuits may have different gains or offsets or the analog-digital converting circuits therein may have different gains or offsets. Such differences among the integrated circuits may decrease the accuracy in a pixel sensing, and thus, hinder an accurate compensation for image data.

SUMMARY

An aspect of the present disclosure is to provide a technology for increasing accuracy in a pixel sensing. Another aspect of the present disclosure is to provide a technology for reducing differences among integrated circuits used for pixel sensing. Still another aspect of the present disclosure is to provide a technology for adjusting a gain or an offset of each integrated circuit.

To this end, in an aspect, the present disclosure provides a pixel sensing device comprising: an amplifying circuit to receive a bias voltage in which a gain or an offset of signal amplification is determined depending on the bias voltage; an analog-front-end circuit to transmit a voltage sensed in a pixel to the amplifying circuit; an analog-digital converting circuit to convert a voltage output from the amplifying circuit into a digital signal; a data transmitting circuit to transmit sensing data corresponding to the digital signal to an external device; and a bias voltage supplying circuit to adjust a level of the bias voltage and transmit the adjusted bias voltage to the amplifying circuit.

The bias voltage supplying circuit may generate a plurality of voltages and select one of the plurality of voltages to adjust the level of the bias voltage.

The pixel sensing device further comprises a data receiving circuit to receive a control signal from the external device and the bias voltage supplying circuit may adjust the level of the bias voltage in accordance with the control signal.

The amplifying circuit may receive a first bias voltage as the bias voltage from the bias voltage supplying circuit and the analog-digital converting circuit may receive a second bias voltage from the bias voltage supplying circuit to determine a gain or an offset of a signal conversion in accordance with the second bias voltage.

The amplifying circuit and the analog-digital converting circuit may further receive a third bias voltage. A gain of a transfer function from the input into the amplifying circuit to the output from the analog-digital converting circuit may be adjusted by the levels of the second bias voltage and the third bias voltage and an offset of the transfer function may be adjusted by the level of the first bias voltage.

The first bias voltage and the second bias voltage may be voltages formed at both ends of a resistance in which a bias current flows.

The bias voltage supplying circuit may comprise a bandgap reference circuit, a low drop-out (LDO) circuit to generate a plurality of voltages by dividing a voltage received from the bandgap reference circuit, a multiplexer (MUX) circuit to select one of the plurality of voltages, and a buffer circuit to buffer an output from the MUX circuit.

The pixel sensing device may further comprise a data receiving circuit to receive a control signal from the external device and the MUX circuit may be controlled by the control signal.

The pixel sensing device may further comprise a sample-and-hold circuit disposed between the analog-front-end circuit and the amplifying circuit and the sample-and-hold circuit may input a voltage, obtained by deducting a reference voltage from an output voltage from the analog-front-end circuit, to the amplifying circuit.

In another aspect, the present disclosure provides a panel driving device for driving a panel on which a plurality of pixels are disposed and a plurality of data lines and a plurality of sensing lines connected with the pixels are disposed, comprising: a data driving circuit to convert image data into a data voltage to supply the data voltage through one of the data lines; a pixel sensing circuit to generate sensing data by amplifying a voltage sensed in a pixel and converting the voltage into a digital signal; and a data processing circuit to compensate the image data using the sensing data, wherein the pixel sensing circuit adjusts a gain or an offset of an amplifying circuit or an analog-digital converting circuit by adjusting a bias voltage.

Each pixel may comprise an organic light emitting diode (OLED).

The pixel sensing circuit may sense an anode voltage of the organic light emitting diode or sense a source voltage or a drain voltage of a driving transistor to supply a driving current to the organic light emitting diode.

The data processing circuit may transmit a control signal to the pixel sensing circuit and the pixel sensing circuit may adjust the bias voltage according to the control signal.

The pixel sensing circuit may adjust an offset of the amplifying circuit by adjusting a bias voltage supplied to the amplifying circuit and may adjust a gain of the analog-digital converting circuit by adjusting another bias voltage supplied to the analog-digital converting circuit.

The pixel sensing circuit may comprise a plurality of integrated circuits.

As described above, according to the present disclosure, it is possible to increase the accuracy of a pixel sensing, to minimize differences among integrated circuits used for a pixel sensing, and to adjust a gain or an offset of each integrated circuit.

DETAILED DESCRIPTION

Figure 1:
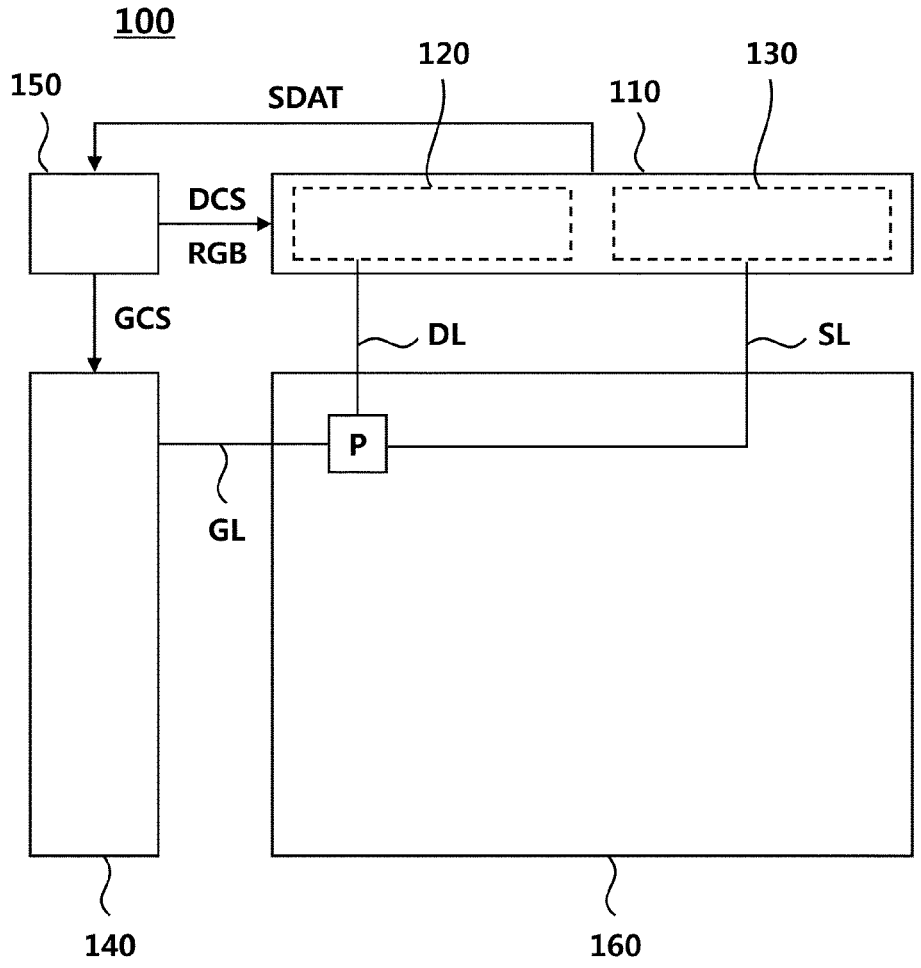
FIG. 1 is a configuration diagram of a display device according to an embodiment.

FIG. 1 is a configuration diagram of a display device according to an embodiment.

Referring to FIG. 1, a display device 100 may comprise a panel 160 and panel driving devices 120, 130, 140, 150 to drive the panel 160.

On the panel 160, a plurality of data lines DL, a plurality of gate lines GL, and a plurality of sensing lines SL may be disposed and a plurality of pixels may be disposed.

The panel driving devices may comprise a data driving circuit 120, a sensing circuit 130, a gate driving circuit 140, and a data processing circuit 150.

The gate driving circuit 140 may supply a scan signal, such as a turn-on voltage or a turn-off voltage, through a gate line GL. When a scan signal of a turn-on voltage is supplied to a pixel P, the pixel P is connected with a data line DL, whereas, when a scan signal of a turn-off voltage is supplied to a pixel P, the pixel P is disconnected from the data line DL.

The data driving circuit 120 may supply a data voltage through a data line DL. A data voltage supplied through a data line DL may be supplied to a pixel P connected with the data line DL according to a scan signal.

The sensing circuit 130 may receive a sensing signal, such as a voltage, a current, or the like, formed in each pixel. The sensing circuit 130 may be connected with each pixel P according to a scan signal or according to a sensing scan signal. Here, the sensing scan signal may be generated by the gate driving circuit 140.

The data processing circuit 150 may supply various control signals to the gate driving circuit 140 and the data driving circuit 120. The data processing circuit 150 may generate a gate control signal GCS to initiate a scan according to a timing implemented in each frame and transmit the gate control signal GCS to the gate driving circuit 140. The data processing circuit 150 may convert image data RGB input from outside into image data RGB in a signal format used in the data driving circuit 120 and transmit a converted image data RGB to the data driving circuit 120. In addition, the data processing circuit 150 may transmit a data control signal DCS to control the data driving circuit 120 to supply a data voltage to each pixel P at an appropriate timing.

The data processing circuit 150 may compensate image data RGB depending on a characteristic of a pixel P and transmit compensated image data. For this, the data processing circuit 150 may receive sensing data SDAT from the sensing circuit 130. The sensing data SDAT may include a measured value regarding the characteristic of the pixel P.

Meanwhile, a data driving circuit 120 may be referred to as a source driver, a gate driving circuit 140 may be referred to as a gate driver, and a data processing circuit 150 may be referred to as a timing controller. A data driving circuit 120 and a sensing circuit 130 may be comprised in an integrated circuit 110 and referred to as a source driver integrated circuit (IC) or as a pixel sensing device. Otherwise, a data driving circuit 120, a sensing circuit 130, and a data processing circuit 150 may be comprised in an integrated circuit and referred to as a combined IC. Although the present disclosure is not limited thereto, descriptions regarding some generally known components of a source driver, a gate driver, or a timing controller will be omitted in the description of the disclosure below. Accordingly, descriptions of embodiments should be understood considering the fact that the descriptions regarding some such components are omitted.

The panel 160 may be an organic light emitting display panel. In this case, each pixel P disposed on the panel 160 may comprise an organic light emitting diode (OLED) and at least one transistor. Characteristics of an organic light emitting diode and at least one transistor comprised in each pixel P may vary with time or depending on surrounding environments. The sensing circuit 130 according to an embodiment may sense characteristics of such elements comprised in each pixel P and transmit them to the data processing circuit 150.

Figure 2:
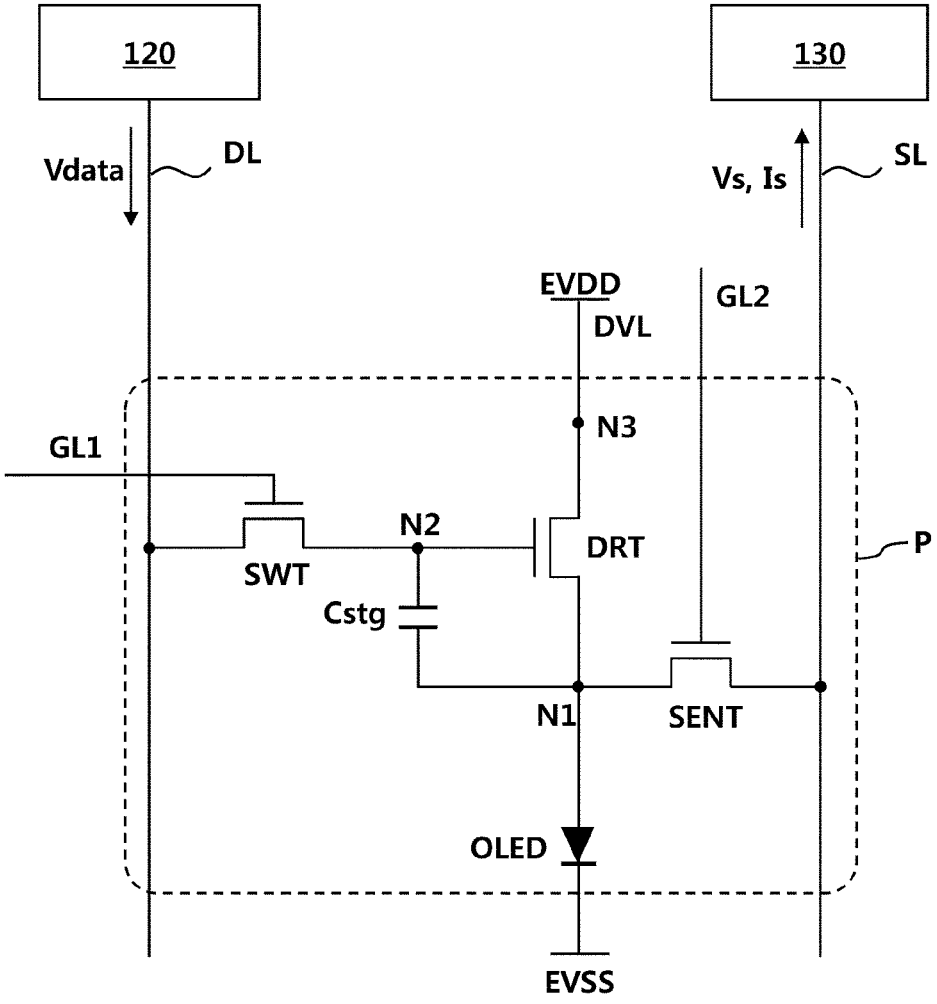
FIG. 2 is a diagram showing a structure of each pixel of FIG. 1 and voltages output from and/or input into a data driving circuit, a pixel, and a sensing circuit according to an embodiment.

FIG. 2 is a diagram showing a structure of each pixel of FIG. 1 and voltages output from and/or input into a data driving circuit, a pixel, and a sensing circuit.

Referring to FIG. 2, a pixel P may comprise an organic light emitting diode OLED, a driving transistor DRT, a switching transistor SWT, a sensing transistor SENT, and a storage capacitor Cstg.

The organic light emitting diode OLED may comprise an anode electrode, an organic layer, and a cathode electrode. According to a control of the driving transistor DRT, the anode electrode is connected in a direction of a driving voltage EVDD and the cathode electrode is connected with a base voltage EVSS, whereby the organic light emitting diode emits light.

The driving transistor DRT may control the brightness of the organic light emitting diode OLED by controlling a driving current supplied to the organic light emitting diode OLED.

A first node N1 of the driving transistor DRT may be electrically connected with the anode electrode of the organic light emitting diode OLED and may be a source node or a drain node. A second node N2 of the driving transistor DRT may be electrically connected with a source node or a drain node of the switching transistor SWT and may be a gate node. A third node N3 of the driving transistor DRT may be electrically connected with a driving voltage line DVL for supplying a driving voltage EVDD and may be a drain node or a source node.

The switching transistor SWT may be electrically connected between a data line DL and the second node N2 of the driving transistor DRT and may be turned on by being provided with a scan signal through a first gate line GL1.

When the switching transistor SWT is turned on, a data voltage Vdata supplied from the data driving circuit 120 through the data line DL is transmitted to the second node N2 of the driving transistor DRT.

The storage capacitor Cstg may be electrically connected between the first node N1 and the second node N2 of the driving transistor DRT.

The storage capacitor Cstg may be a parasitic capacitor present between the first node N1 and the second node N2 of the driving transistor DRT or an external capacitor intentionally disposed outside the driving transistor DRT.

The sensing transistor SENT may connect the first node N1 of the driving transistor DRT with a sensing line SL and, through the sensing line SL, a reference voltage may be transmitted to the first node N1 and a characteristic, such as a voltage Vs or a current Is, of the first node N1 may be transmitted to the sensing circuit 130.

The sensing circuit 130 measures characteristics of a pixel P using a sensing signal (Vs or Is) transmitted through the sensing line SL.

Measuring a voltage in the first node N1 allows identifying a threshold voltage, the mobility, a current characteristic, or the like of the driving transistor DRT. In addition, measuring a voltage in the first node N1 allows identifying a deterioration degree of an organic light emitting diode OLED using a parasitic capacitance or a current characteristic of the organic light emitting diode OLED.

The sensing circuit 130 may measure a voltage in the first node N1 and transmit a measured value to the data processing circuit (150 in FIG. 1). The data processing circuit (150 in FIG. 1) may identify characteristics of each pixel P by analyzing the voltage of the first node N1.

Figure 3A:
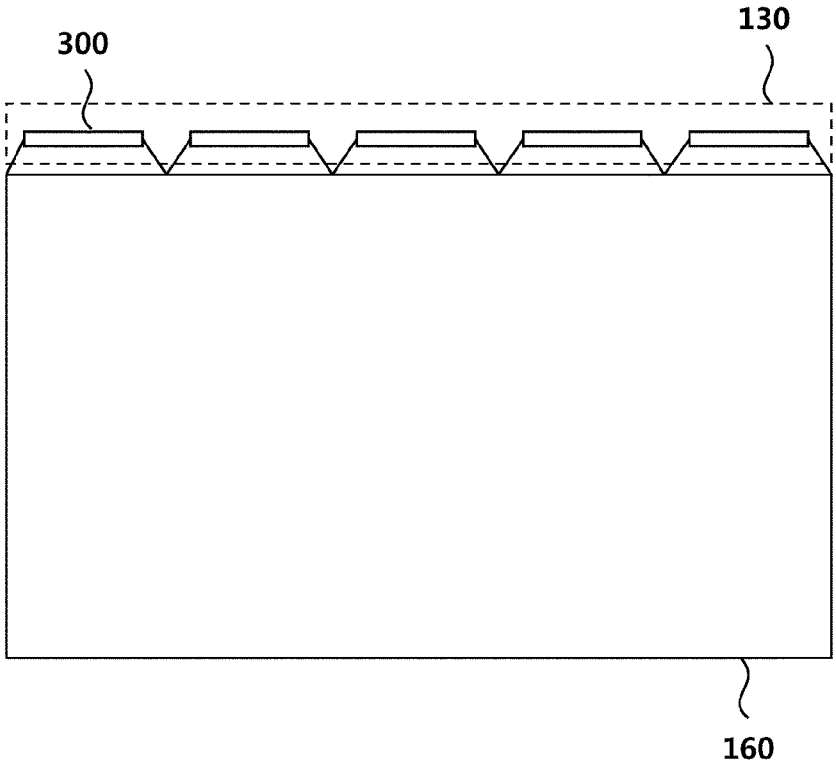
FIG. 3A is an arrangement diagram of a sensing circuit according to an embodiment.

FIG. 3A is an arrangement diagram of a sensing circuit according to an embodiment.

Referring to FIG. 3A, a sensing circuit 130 may comprise a plurality of sensing integrated circuits 300.

The sensing integrated circuits 300 may sense pixels disposed on a panel 160 by zones.

The sensing integrated circuits 300 may be different from each other depending on their manufacturing processes, driving environments, or the like. For example, each sensing integrated circuit 300 may comprise an amplifying circuit and an analog-digital converting circuit, and a gain or an offset of an amplifying circuit of one sensing integrated circuit may be different from that of an amplifying circuit of another sensing integrated circuit or a gain or an offset of an analog-digital converting circuit of one sensing integrated circuit may be different from that of an analog-digital converting circuit of another sensing integrated circuit. Such differences among the respective sensing integrated circuits 300 may decrease the accuracy in a pixel sensing and hinder an accurate compensation for image data.

In order to solve such a problem, each sensing integrated circuit 300 may comprise an element to adjust a gain or an offset of an amplifying circuit or an analog-digital converting circuit by adjusting a bias voltage.

Figure 3B:
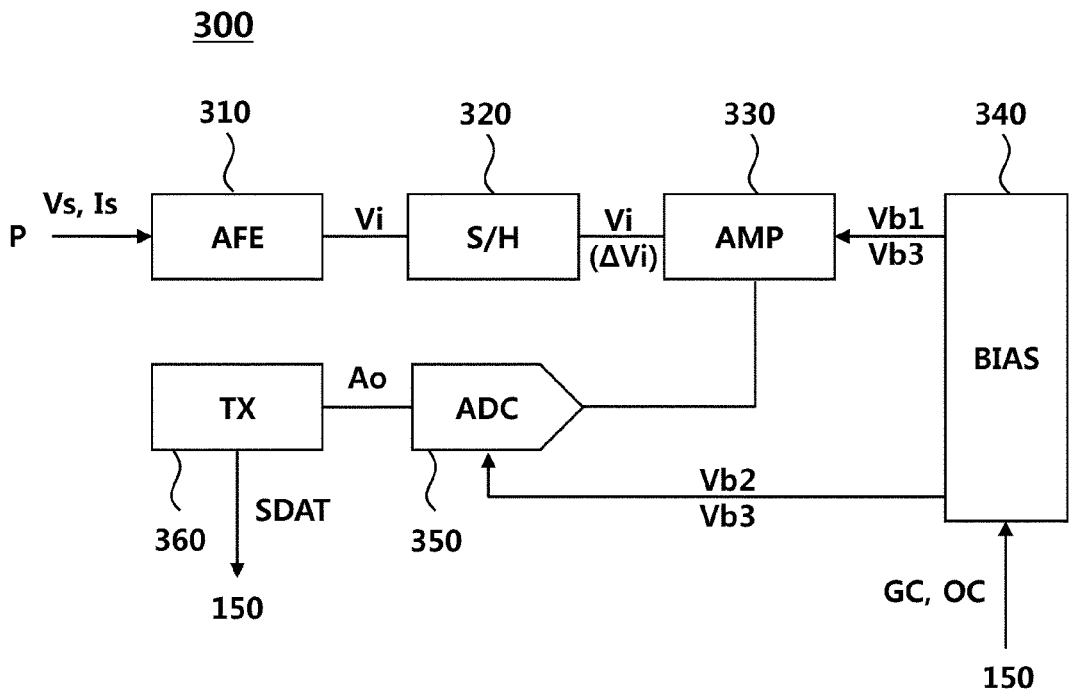
FIG. 3B is a configuration diagram of a sensing integrated circuit according to an embodiment.

FIG. 3B is a configuration diagram of a sensing integrated circuit according to an embodiment.

Referring to FIG. 3B, a sensing integrated circuit 300 may comprise an analog front end circuit (AFE) 310, a sample and hold circuit (S/H) 320, an amplifying circuit (AMP) 330, a bias voltage supplying circuit (BIAS) 340, an analog-digital converting circuit (ADC) 350, and a data transmitting 360 circuit (TX).

The analog front end circuit 310 may sense a pixel P and form a sensing voltage Vi by processing a voltage Vs or a current Is transmitted from the pixel P. Depending on embodiments, the sensing voltage Vi may be the same as the voltage Vs transmitted from the pixel P or may be the same as a voltage obtained by integrating the current Is. The analog front end circuit 310 may transmit the sensing voltage Vi to the amplifying circuit 330. The amplifying circuit 330 may amplify the sensing voltage Vi or a difference ΔVi between the sensing voltage Vi and a reference voltage and transmit an amplified sensing voltage or an amplified difference to the analog-digital converting circuit 350.

Between the analog front end circuit 310 and the amplifying circuit 330, the sample and hold circuit 320 may be disposed. The sample and hold circuit 320 may separate the analog front end circuit 310 and the amplifying circuit 330 in terms of signal, temporarily store a sensing voltage Vi output from the analog front end circuit 310, and input the sensing voltage Vi or a difference ΔVi between the sensing voltage Vi and a reference voltage into the amplifying circuit 330.

The amplifying circuit 330 may amplify the sensing voltage Vi or the difference ΔVi between the sensing voltage Vi and the reference voltage transmitted through an input terminal, and then, transmit an amplified one to the analog-digital converting circuit 350. The analog-digital converting circuit 350 may convert a voltage output from the amplifying circuit 330 into a digital signal Ao.

The data transmitting circuit 360 may generate sensing data SDAT by processing the digital signal Ao and transmit the sensing data SDAT to an external device (for example, a data processing circuit 150).

Here, the amplifying circuit 330 may have a gain and an offset for amplification and the analog-digital converting circuit 350 may have a gain and an offset for conversion.

Hereinafter, for the convenience of description, a gain and an offset of the amplifying circuit 330 will respectively be referred to as an amplification gain and an amplification offset, and a gain and an offset of the analog-digital converting circuit 350 will respectively be referred to as a conversion gain and a conversion offset.

For being driven, the amplifying circuit 330 and the analog-digital converting circuit 350 may be provided with bias voltages Vb1, Vb2, Vb3 by the bias voltage supplying circuit 340. In an embodiment, the bias voltages Vb1, Vb2, Vb3 may perform a function in addition to a function as driving voltages. The sensing circuit 130 may adjust at least one of an amplification gain, an amplification offset, a conversion gain, and a conversion offset by adjusting the bias voltages Vb1, Vb2, Vb3.

The bias voltage supplying circuit 340 may adjust the levels of the bias voltages Vb1, Vb2, Vb3. In addition, the bias voltage supplying circuit 340 may adjust at least one of an amplification gain, an amplification offset, a conversion gain, and a conversion offset by supplying the bias voltages Vb1, Vb2, Vb3 having adjusted levels to the amplifying circuit 330 and/or the analog-digital converting circuit 350.

The bias voltage supplying circuit 340 may receive a gain control signal GC and/or an offset control signal OC and adjust the bias voltages Vb1, Vb2, Vb3 according to the gain control signal GC and/or the offset control signal OC.

The sensing circuit 130 may receive a gain control signal GC and/or an offset control signal OC from an external device (for example, a data processing circuit 150). For this, the sensing circuit 130 may further comprise a data receiving circuit (not shown). A gain control signal GC and/or an offset control signal OC may be 2-bit digital signals or analog signals.

Meanwhile, a display device may correct a measured value included in sensing data without an adjustment of a gain or an offset by the sensing circuit 130. An adjustment of a gain or an offset may be referred to as an analog correction, whereas a correction for sensing data may be referred to as a digital correction. However, in a digital correction, there might be a disused area.

Figure 4:
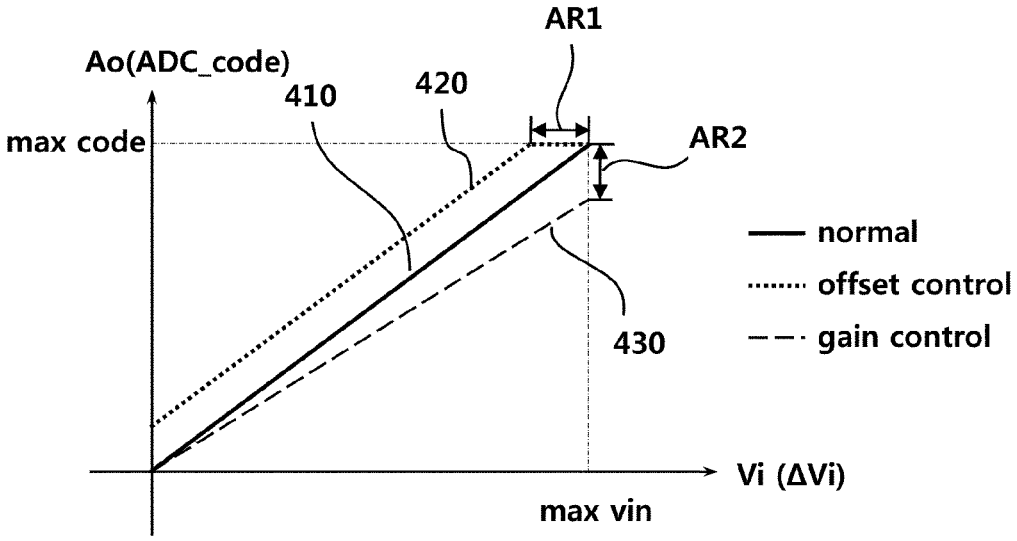
FIG. 4 is a graph for illustrating disused areas appearing in a digital correction according to an embodiment.

FIG. 4 is a graph for illustrating disused areas appearing in a digital correction according to one embodiment.

In FIG. 4, a first line 410 represents a corresponding relation between an input voltage (Vi or ΔVi) of the amplifying circuit and an output code (a digital signal Ao) of the analog-digital converting circuit in a case when a gain and an offset are normal. A second line 420 represents a corresponding relation therebetween in a case when the offset is different from that of the first line 410 and a third line 430 represents a corresponding relation therebetween in a case when the gain is different from that of the first line 410.

In a case of the second line 420, the offset may be corrected using the digital correction, however, there might be an unused area AR1 which is a partial area, that cannot be used, of an input voltage Vi of the amplifying circuit. In a case of the third line 430, the gain may be corrected using the digital correction, however, there might be an unused area AR2 which is a partial area, that cannot be used, of an output code of the analog-digital converting circuit.

In the sensing circuit according to an embodiment, the unused areas may be reduced by adjusting the gain or offset of the amplifying circuit and/or the analog-digital converting circuit.

Figure 5:
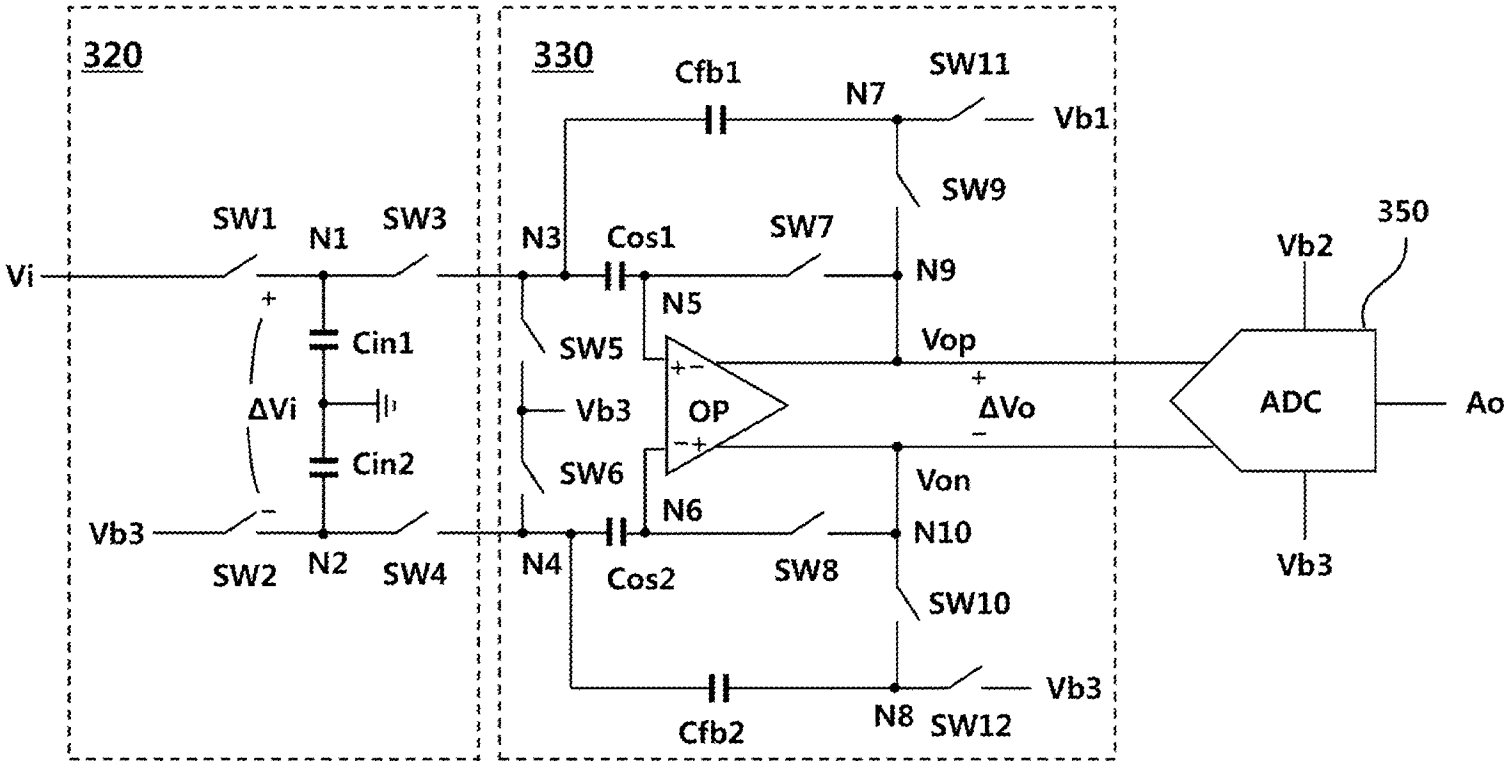
FIG. 5 is a configuration diagram of a sample-and-hold circuit, an amplifying circuit, and an analog-digital converting circuit according to an embodiment.

FIG. 5 is a configuration diagram of a sample-and-hold circuit, an amplifying circuit, and an analog-digital converting circuit according to an embodiment.

Referring to FIG. 5, the sample and hold circuit 320 may comprise a first input capacitor Cin1 connected between a ground and a first node N1 and a second input capacitor Cin2 connected between the ground and a second node N2, may comprise a first switch SW1 to control the connection between the first node N1 and a sensing voltage Vi and a second switch SW2 to control the connection between a third bias voltage Vb3 and the second node N2, and may comprise a third switch SW3 to control the connection between a third node N3, corresponding to a first input terminal of the amplifying circuit 330, and the first node N1 and a fourth switch SW4 to control the connection between a fourth node N4, corresponding to a second input terminal of the amplifying circuit 330, and the second node N2.

The sample and hold circuit 320 may store a sensing voltage Vi in the first input capacitor Cin1 and a third bias voltage Vb3 in the second input capacitor Cin2. In addition, the sample and hold circuit 320 may input a delta voltage ΔVi, corresponding to a difference between the sensing voltage Vi and the third bias voltage Vb3, into the third and the fourth nodes N3, N4, which are the first and the second input terminals of the amplifying circuit.

The amplifying circuit 330 may comprise a fifth switch SW5 to control the connection between the third node N3, corresponding to the first input terminal, and a third bias voltage Vb3 and a sixth switch SW6 to control the connection between the fourth node N4, corresponding to the second input terminal, and the third bias voltage Vb3. The amplifying circuit 330 may further comprise an operational amplifier OP and a first offset capacitor Cos1 disposed between a fifth node N5, corresponding to one input terminal of the operational amplifier OP, and the third node N3. In addition, the amplifying circuit 330 may comprise a second offset capacitor Cos2 disposed between a sixth node N6, corresponding to the other input terminal of the operational amplifier OP, and the fourth node N4.

The amplifying circuit 330 may comprise a seventh switch SW7 to control the connection between a ninth node N9, corresponding to one output terminal of the operational amplifier OP, and the fifth node N5 and a eighth switch SW8 to control the connection between a tenth node N10, corresponding to the other output terminal of the operational amplifier OP, and the sixth node N6.

The amplifying circuit 330 may comprise a seventh node N7 to receive a first bias voltage Vb1 through an eleventh switch SW11 and an eighth node N8 to receive the third bias voltage Vb3 through a twelfth switch SW12.

The amplifying circuit 330 may comprise a first feedback capacitor Cfb1 disposed between the seventh node N7 and the third node N3 and a second feedback capacitor Cfb2 disposed between the eighth node N8 and the fourth node N4.

The amplifying circuit 330 may comprise a ninth switch SW9 to control the connection between the seventh node N7 and the ninth node N9 and a tenth switch SW10 to control the connection between the eighth node N8 and the tenth node N10.

Input terminals of the analog-digital converting circuit 350 may respectively be connected with the ninth node N9 and the tenth node N10, which correspond to the output terminals of the operational amplifier OP. These connections allow a difference ΔVo, between a first operational amplifier output voltage Vop formed in the ninth node N9 and a second operational amplifier output voltage Von formed in the tenth node N10, to be input to the analog-digital converting circuit 350.

The analog-digital converting circuit 350 may be provided with a second bias voltage Vb2 and a third bias voltage Vb3 and convert an input voltage ΔVo into an output code Ao.

In terms of operation, the sample and hold circuit 320, the amplifying circuit 330, and the analog-digital converting circuit 350 may have two phases.

Figure 6:
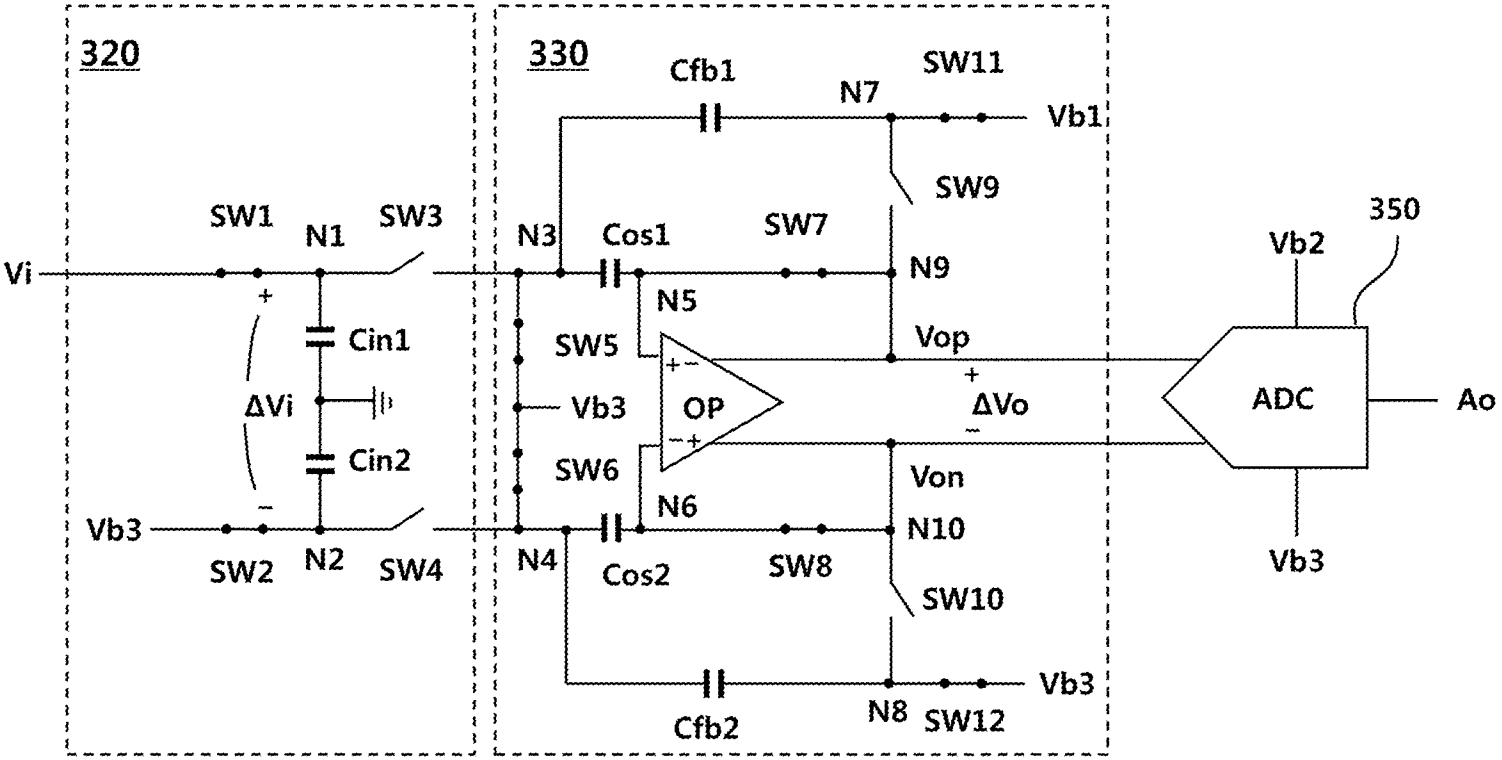
FIG. 6 is a state diagram showing a first phase of a sample-and-hold circuit, an amplifying circuit, and an analog-digital converting circuit according to an embodiment.
Figure 7:
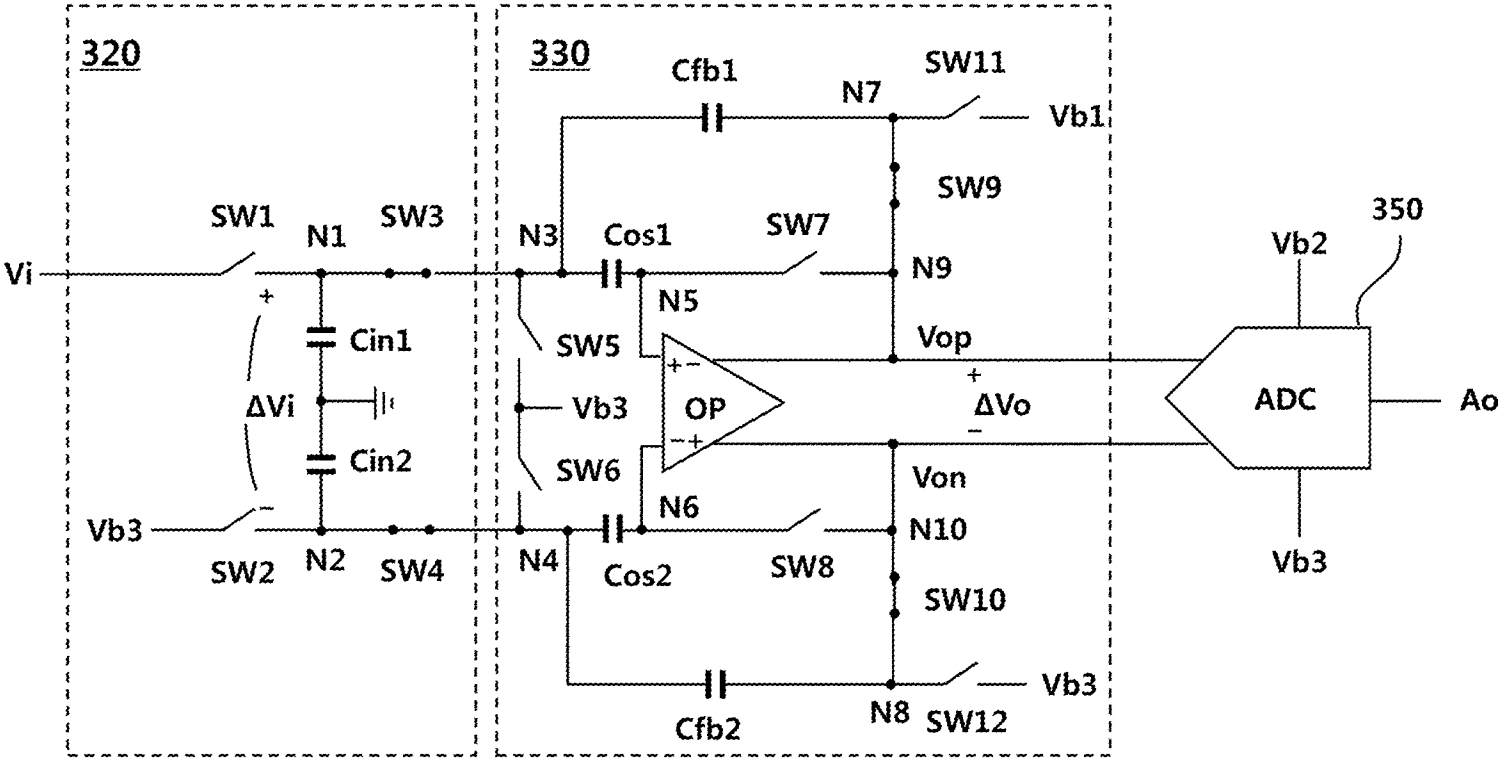
FIG. 7 is a state diagram showing a second phase of a sample-and-hold circuit, an amplifying circuit, and an analog-digital converting circuit according to an embodiment.

FIG. 6 is a state diagram showing a first phase of a sample-and-hold circuit, an amplifying circuit, and an analog-digital converting circuit according to an embodiment and FIG. 7 is a state diagram showing a second phase of a sample-and-hold circuit, an amplifying circuit, and an analog-digital converting circuit according to an embodiment.

In the sample and hold circuit 320 in the first phase, the first switch SW1 and the second switch SW2 may be turned on so as to store the sensing voltage Vi and the third bias voltage Vb3 in the input capacitors Cin1, Cin2. The third switch SW3 and the fourth switch SW4 may be turned off so as to separate the first node N1 and the second node N2 from the third node N3 and the fourth node N4, which correspond to the input terminals of the amplifying circuit 330.

In the amplifying circuit 330 in the first phase, the fifth switch SW5 and the sixth switch SW6 may be turned on to form a third bias voltage Vb3 at the third node N3 and the fourth node N4. The seventh switch SW7 and the eighth switch SW8 may be turned on to connect the fifth node N5, which is an input terminal of the operational amplifier, with the ninth node N9, which is an output terminal of the operational amplifier, and to connect the sixth node N6, which is the other input terminal of the operational amplifier, with the tenth node N10, which is the other output terminal of the operational amplifier. The eleventh switch SW11 may be turned on to form a first bias voltage Vb1 at the seventh node N7 and the twelfth switch SW12 may be turned on to form a third bias voltage Vb3 at the eighth node N8. Here, a voltage, corresponding to a difference between the first bias voltage Vb1 and the third bias voltage Vb3, may be formed between both ends of the first feedback capacitor Cfb1 and the same third bias voltage Vb3 may be formed at both ends of the second feedback capacitor Cfb2.

In the sample and hold circuit 320 in the second phase, the first switch SW1 and the second switch SW2 may be turned off, whereas the third switch SW3 and the fourth switch SW4 may be turned on. Here, a difference ΔVi between the sensing voltage Vi and the third bias voltage Vb3 may be formed between the third node N3 and the fourth node N4.

In the amplifying circuit 330 in the second phase, the fifth switch SW5, the sixth switch SW6, the seventh switch SW7, the eighth switch SW8, the eleventh switch SW11, and the twelfth switch SW12 may be turned off, whereas the ninth switch SW9 and the tenth switch SW10 may be turned on.

A relational expression of inputs and outputs of the amplifying circuit 330 in the second phase is as Expression 1.

$$\Delta Vo=\alpha(\Delta Vi)-(Vb1-Vb3),\alpha=Cin/Cfb \quad \text{[Expression 1]}$$

Here, Cin is a capacitance of the first input capacitor Cin1 and the second input capacitor Cin2 and Cfb is a capacitance of the first feedback capacitor Cfb1 and the second feedback capacitor Cfb2.

A relational expression of inputs and outputs of the analog-digital converting circuit 350 is as follows.

$$Ao=\beta(1/(Vb2-Vb3))+\beta \quad \text{[Expression 2]}$$

Here, β relates to a resolving ability of the analog-digital converting circuit 350. When the analog-digital converting circuit 350 has a 10-bit resolving ability, β may be 1023/2.

A transfer function Z from an input of the amplifying circuit 330 to an output of the analog-digital converting circuit 350, calculated using Expressions 1 and 2 is as Expression 3.

$$\text{Transfer function}(Z)=Ao/\Delta Vo=\{\beta(1/(Vb2-Vb3))+\beta\}/\{\alpha(\Delta Vi)-(Vb1-Vb3)\} \quad \text{[Expression 3]}$$

When making Expression 3 brief, a transfer function gain, which is a gain of the transfer function Z, may be determined as αβ/(Vb2−Vb3), and a transfer function offset may be determined as −β(Vb1−Vb3)/(Vb2−Vb3)+β.

According to such a transfer function, the sensing circuit may adjust a transfer function gain using the second bias voltage Vb2 and the third bias voltage Vb3, and a transfer function offset using the first bias voltage Vb1, the second bias voltage Vb2, and the third bias voltage Vb3.

Figure 8:
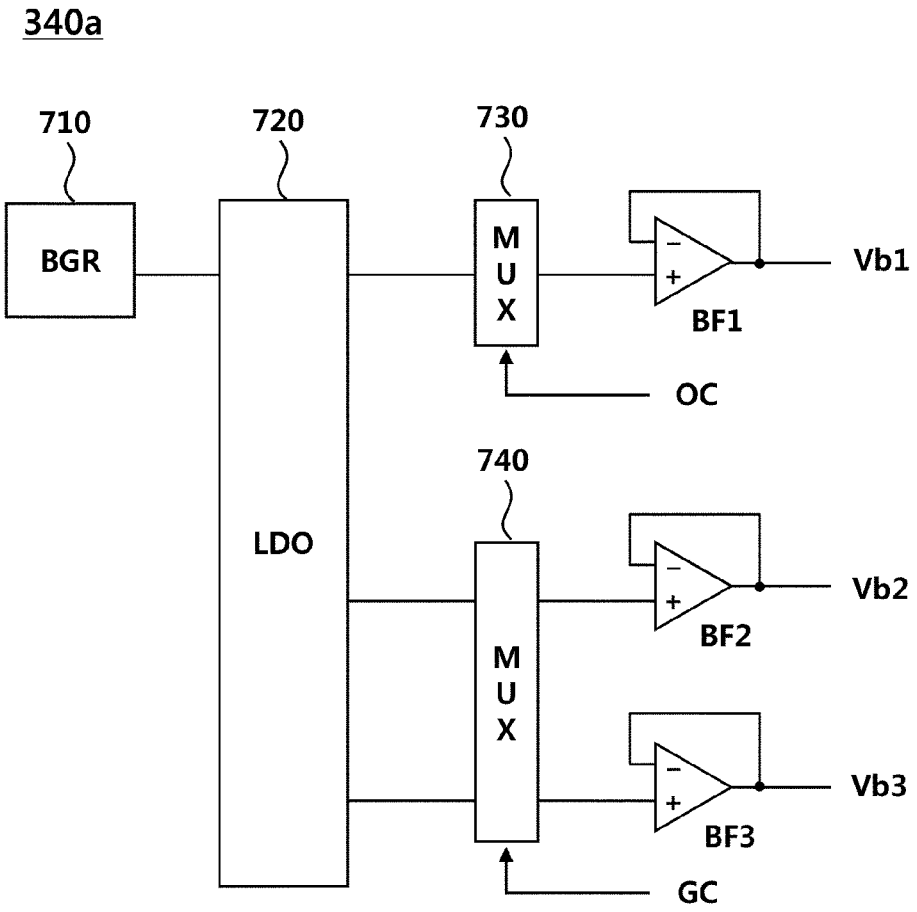
FIG. 8 is a configuration diagram of a first example of a bias voltage supplying circuit according to an embodiment.

FIG. 8 is a configuration diagram of a first example of a bias voltage supplying circuit according to an embodiment.

Referring to FIG. 8, a bias voltage supplying circuit 340*a* may comprise a band gap reference (BGR) circuit 710, a low drop out (LDO) circuit 720, multiplexer (MUX) circuits 730, 740, and buffer circuits BF1, BF2, and BF3.

The band gap reference circuit 710 may generate a voltage reference independent from a temperature.

The LDO circuit 720 may generate a plurality of voltages using the voltage reference received from the band gap reference circuit 710. Here, the LDO circuit 720 may divide the voltage reference into a plurality of voltages using a resistor string or use another method to generate a plurality of voltages.

A first MUX circuit 730 may generate a first bias voltage Vb1 by selecting one of the plurality of voltages generated by the LDO circuit 720. The first MUX circuit 730 may receive an offset control signal OC and determine the level of the first bias voltage Vb1 according to the offset control signal OC. A first buffer circuit BF1 may buffer the first bias voltage Vb1 using a buffer circuit.

A second MUX circuit 740 may generate a second bias voltage Vb2 by selecting one of the plurality of voltages generated by the LDO circuit 720 and generate a third bias voltage Vb3 by selecting another one or the same one thereof. The second MUX circuit 740 may determine the level of the second bias voltage Vb2 according to a gain control signal GC and also determine the level of the third bias voltage Vb3 according to the gain control signal GC. A second buffer circuit BF2 and a third buffer circuit BF3 may buffer the second bias voltage Vb2 and the third bias voltage Vb3 using buffer circuits.

Figure 9:
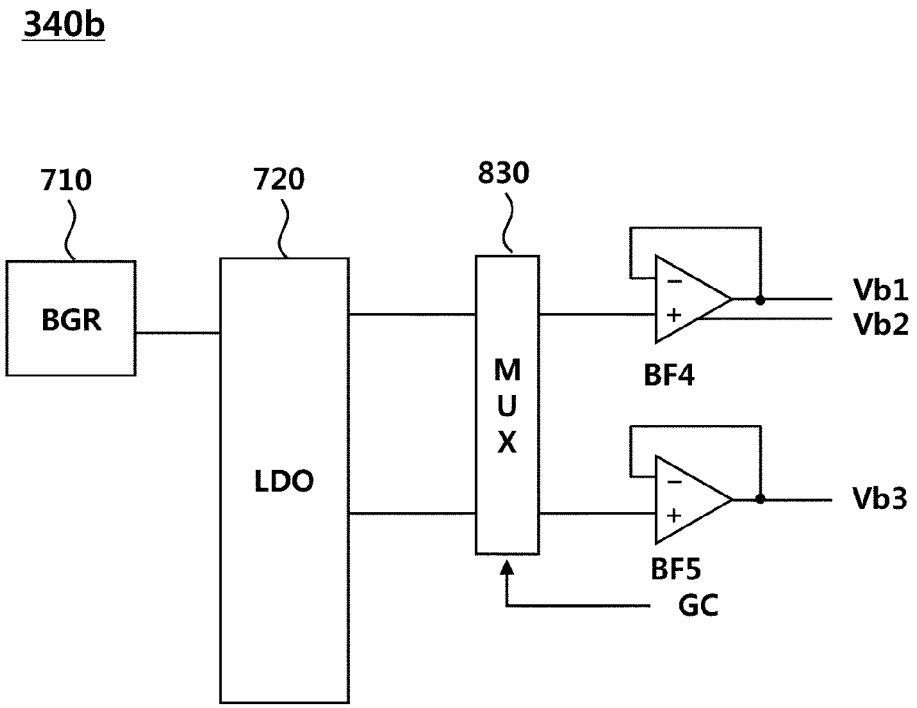
FIG. 9 is a configuration diagram of a second example of a bias voltage supplying circuit according to an embodiment.

FIG. 9 is a configuration diagram of a second example of a bias voltage supplying circuit according to an embodiment.

Referring to FIG. 9, a bias voltage supplying circuit 340*b* may comprise a band gap reference (BGR) circuit 710, a low drop out (LDO) circuit 720, a multiplexer (MUX) circuit 830, and buffer circuits BF4, BF5.

The MUX circuit 830 may select one of a plurality of voltages generated by the LDO circuit 720 and transmit it to a fourth buffer circuit BF4. The fourth buffer circuit BF4 may generate a first bias voltage Vb1 and a second bias voltage Vb2 using a dividing circuit using a bias current.

In addition, the MUX circuit 830 may select another one or the same one of the plurality of voltages generated by the LDO circuit 720 and transmit it to a fifth buffer circuit BF5. The fifth buffer circuit BF5 may generate a third bias voltage using a buffer circuit.

In the second example, the first bias voltage Vb1 and the second bias voltage Vb2 may be generated in the fourth buffer circuit BF4.

Figure 10:
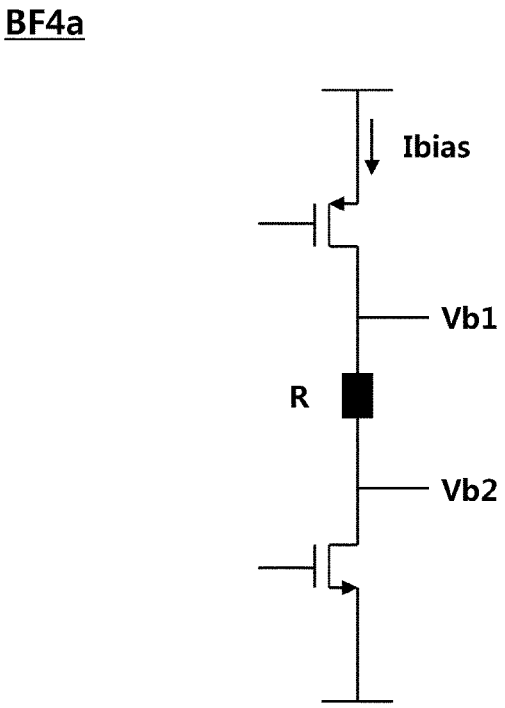
FIG. 10 is a diagram showing a first example of an outputting part of a fourth buffer circuit according to an embodiment.
Figure 11:
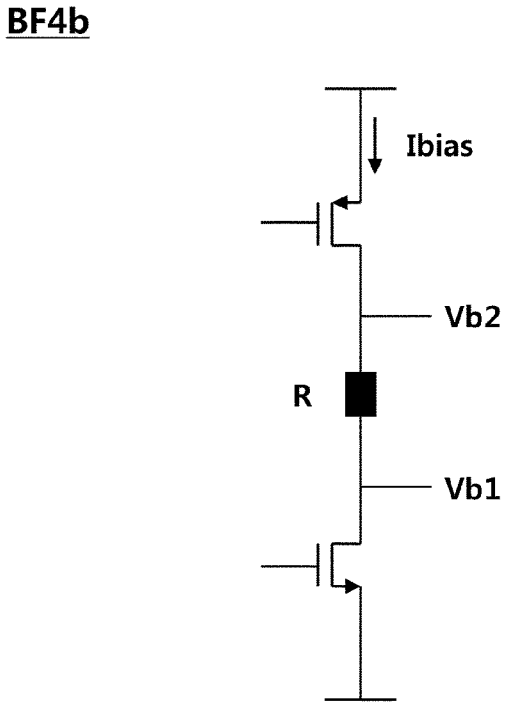
FIG. 11 is a diagram showing a second example of an outputting part of a fourth buffering circuit according to an embodiment.

FIG. 10 is a diagram showing a first example of an outputting circuit of a fourth buffer circuit BF4*a* and FIG. 11 is a diagram showing a second example of an outputting circuit of a fourth buffer circuit BF4*b*.

Referring to FIG. 10, a bias current Ibias may be supplied to an output resistance R, a first bias voltage Vb1 may be formed and output from an upper end of the output resistance R, and a second bias voltage Vb2 may be formed and output from a lower end of the output resistance R. Here, their relation may be as follows: Vb1−Vb2=R·Ibias.

In addition, here, a gain of a transfer function from the amplifying circuit to the analog-digital converting circuit may be Vb2+Ibias·R and an offset of the transfer function may be −β·Ibias·R/(Vb2−Vb3).

Referring to FIG. 11, a bias current Ibias may be supplied to an output resistance R, a second bias voltage Vb2 may be formed and output from an upper end of the output resistance R, and a first bias voltage Vb1 may be formed and output from a lower end of the output resistance R. Here, their relation may be as follows: Vb2−Vb1=R·Ibias.

In addition, here, a gain of a transfer function from the amplifying circuit to the analog-digital converting circuit may be Vb2−Ibias·R and an offset of the transfer function may be +β·Ibias·R/(Vb2−Vb3).

As described above, according to the present disclosure, it is possible to increase the accuracy of a pixel sensing, to minimize differences among integrated circuits used for the pixel sensing, and to adjust a gain or an offset of each integrated circuit.

What is claimed is:

1. A pixel sensing device, comprising:

an amplifying circuit to receive a bias voltage and to determine a gain or an offset of signal amplification depending on the bias voltage;

an analog-front-end circuit to transmit a voltage sensed in a pixel to the amplifying circuit;

an analog-digital converting circuit to convert a voltage output from the amplifying circuit into a digital signal;

a data transmitting circuit to transmit sensing data corresponding to the digital signal to an external device;

a bias voltage supplying circuit to adjust a level of the bias voltage and transmit the adjusted bias voltage to the amplifying circuit, and a sample-and-hold circuit disposed between the analog-front-end circuit and the amplifying circuit.

2. The pixel sensing device of claim 1, wherein the bias voltage supplying circuit generates a plurality of voltages and selects one of the plurality of voltages to adjust the level of the bias voltage.

3. The pixel sensing device of claim 1 further comprising a data receiving circuit to receive a control signal from the external device, wherein the bias voltage supplying circuit adjusts the level of the bias voltage in accordance with the control signal.

4. The pixel sensing device of claim 1, wherein the amplifying circuit receives a first bias voltage as the bias voltage from the bias voltage supplying circuit and the analog-digital converting circuit receives a second bias voltage from the bias voltage supplying circuit to determine a gain or an offset of a signal conversion in accordance with the second bias voltage.

5. The pixel sensing device of claim 4, wherein the amplifying circuit and the analog-digital converting circuit further receive a third bias voltage, a gain of a transfer function from an input into the amplifying circuit to the output from the analog-digital converting circuit is adjusted by levels of the second bias voltage and the third bias voltage, and an offset of the transfer function is adjusted by the level of the first bias voltage.

6. The pixel sensing device of claim 4, wherein the first bias voltage and the second bias voltage are voltages formed at both ends of a resistance in which bias current flows.

7. The pixel sensing device of claim 1, wherein the bias voltage supplying circuit comprises a bandgap reference circuit, a low drop-out (LDO) circuit to generate a plurality of voltages by dividing a voltage received from the bandgap reference circuit, a multiplexer (MUX) circuit to select one of the plurality of voltages, and a buffer circuit to buffer an output from the MUX circuit.

8. The pixel sensing device of claim 7, further comprising a data receiving circuit to receive a control signal from the external device, wherein the MUX circuit is controlled by the control signal.

9. The pixel sensing device of claim 1, wherein the sample-and-hold circuit inputs a voltage, obtained by deducting a reference voltage from an output voltage from the analog-front-end circuit, to the amplifying circuit.

10. A panel driving device for driving a panel on which a plurality of pixels are disposed and a plurality of data lines and a plurality of sensing lines connected with the pixels are disposed, the panel driving device comprising:

a data driving circuit to convert image data into a data voltage to supply the data voltage through one of the plurality of data lines;

a pixel sensing circuit to generate sensing data by amplifying a voltage sensed in a pixel and converting the voltage into a digital signal; and a data processing circuit to compensate the image data using the sensing data;

wherein the pixel sensing circuit adjusts a gain or an offset of an amplifying circuit or an analog-digital converting circuit by adjusting a bias voltage, wherein the analog-digital converting circuit receives a bias voltage from the bias voltage supplying circuit to determine the gain or the offset of a signal conversion in accordance with the bias voltage.

11. The panel driving device of claim 10, wherein each of the plurality of pixels comprises an organic light emitting diode (OLED).

12. The panel driving device of claim 11, wherein the pixel sensing circuit senses an anode voltage of the organic light emitting diode or senses a source voltage or a drain voltage of a driving transistor to supply a driving current to the organic light emitting diode.

13. The panel driving device of claim 10, wherein the data processing circuit transmits a control signal to the pixel sensing circuit and the pixel sensing circuit adjusts the bias voltage according to the control signal.

14. The panel driving device of claim 10, wherein the pixel sensing circuit adjusts an offset of the amplifying circuit by adjusting a first bias voltage supplied to the amplifying circuit and adjusts a gain of the analog-digital converting circuit by adjusting a second bias voltage supplied to the analog-digital converting circuit.

15. The panel driving device of claim 10, wherein the pixel sensing circuit may comprise a plurality of integrated circuits.

16. The panel driving device of claim 10, wherein the amplifying circuit receives a first bias voltage as the bias voltage from the bias voltage supplying circuit and the analog-digital converting circuit receives a second bias voltage from the bias voltage supplying circuit to determine a gain or an offset of a signal conversion in accordance with the second bias voltage.

* * * * *